US008136781B2

(12) United States Patent
Krohmer

(10) Patent No.: US 8,136,781 B2
(45) Date of Patent: Mar. 20, 2012

(54) WORKPIECE SUPPORT APPARATUS AND METHOD

(75) Inventor: Steven Krohmer, Coon Rapids, MN (US)

(73) Assignee: Rockler Companies, Inc., Medina, MN (US)

( * ) Notice: Subject to any disclaimer, the term of this patent is extended or adjusted under 35 U.S.C. 154(b) by 1121 days.

(21) Appl. No.: 11/840,348

(22) Filed: Aug. 17, 2007

(65) Prior Publication Data

US 2008/0042034 A1 Feb. 21, 2008

Related U.S. Application Data

(60) Provisional application No. 60/838,466, filed on Aug. 17, 2006.

(51) Int. Cl.
*B42F 13/00* (2006.01)

(52) U.S. Cl. ..... 248/339; 248/308; 248/294.1; 248/691; 248/692

(58) Field of Classification Search ..... 248/304, 248/308, 339, 340, 341, 294.1
See application file for complete search history.

(56) References Cited

U.S. PATENT DOCUMENTS

| | | | | | |
|---|---|---|---|---|---|
| 1,040,462 | A | * | 10/1912 | Thurman | 248/216.4 |
| 1,445,372 | A | * | 2/1923 | Wagner | 248/217.1 |
| 1,510,978 | A | * | 10/1924 | Conklin | 411/400 |
| 2,510,708 | A | * | 6/1950 | Marshall | 362/378 |
| 2,854,824 | A | * | 10/1958 | Curry et al. | 405/302.1 |
| 2,891,752 | A | * | 6/1959 | Genter | 248/71 |
| 3,339,449 | A | * | 9/1967 | Lerich | 411/53 |
| 3,620,490 | A | * | 11/1971 | Roberts et al. | 248/58 |
| 3,620,493 | A | * | 11/1971 | Huver | 248/692 |
| 4,129,217 | A | | 12/1978 | Campbell | 211/95 |
| 4,361,931 | A | | 12/1982 | Schnelle et al. | 16/252 |
| 4,373,632 | A | * | 2/1983 | VanZandt | 206/457 |
| D300,604 | S | | 4/1989 | Nakamura | |
| D313,544 | S | | 1/1991 | Scherer | |
| 5,028,030 | A | * | 7/1991 | Lewis | 248/493 |
| D327,000 | S | | 6/1992 | Johnson, Jr. | |
| 5,163,751 | A | * | 11/1992 | Bottiglieri | 362/376 |
| 5,463,796 | A | | 11/1995 | Brüstle et al. | 16/383 |
| 5,673,803 | A | * | 10/1997 | Burback | 211/87.01 |
| 5,737,804 | A | | 4/1998 | Ferrari et al. | 16/242 |
| 5,924,667 | A | * | 7/1999 | Grahn et al. | 248/304 |
| 6,032,333 | A | | 3/2000 | Brüstle | 16/242 |

(Continued)

FOREIGN PATENT DOCUMENTS

DE 1 904 781 1/1969

(Continued)

OTHER PUBLICATIONS

Blum Inserts Hinges—disclosure and photos from www.rockler.com (hinge mount with expanding gripper arms known prior to Aug. 17, 2006) (7 pages).

(Continued)

*Primary Examiner* — Terrell McKinnon
*Assistant Examiner* — Michael McDuffie
(74) *Attorney, Agent, or Firm* — Altera Law Group, LLC

(57) ABSTRACT

A hanging device is provided to hold a workpiece, where the workpiece has a preformed hole therein. The hanging device has an expandable element, such as a cup, that is adapted to be selectively retained within the hold in the workpiece. A hook is connected to the expandable element for use in supporting the expandable element and workpiece affixed thereto.

19 Claims, 5 Drawing Sheets

U.S. PATENT DOCUMENTS

| | | | | |
|---|---|---|---|---|
| 6,044,673 | A * | 4/2000 | Jefferson | 70/212 |
| RE37,236 | E | 6/2001 | Brüstle et al. | 16/383 |
| 6,416,028 | B1 * | 7/2002 | Miller et al. | 248/339 |
| 6,601,814 | B2 * | 8/2003 | Kovacik et al. | 248/339 |
| 6,845,544 | B2 | 1/2005 | Hofer | 16/246 |
| 6,959,582 | B2 * | 11/2005 | Peterhansel et al. | 72/395 |
| 7,017,895 | B2 | 3/2006 | Sakamoto | 269/32 |
| 7,152,837 | B1 * | 12/2006 | Babjak | 248/304 |
| D566,533 | S | 4/2008 | Frank | |

FOREIGN PATENT DOCUMENTS

| | | |
|---|---|---|
| DE | 25 24 503 | 5/1975 |
| DE | 28 37 327 | 8/1978 |

OTHER PUBLICATIONS

Cam Clamps, 1 page, Rockler Woodworking and Hardware, website screen print (known prior to Aug. 17, 2006).

* cited by examiner

WORKPIECE SUPPORT APPARATUS AND METHOD

BACKGROUND

This disclosure relates to a tool and method of use therefor to support a workpiece for finish processing on the workpiece. When cabinet doors that have holes adapted for European-style hinges are finished by either a consumer or a cabinet maker, the doors are often sprayed with lacquer or paint. A common problem that is encountered in this process is finding a method of hanging a door in a manner so as to not leave a mark or drill a hole in the door's surface. Additionally, it is difficult to find an adequate method of hanging a cabinet door that will prevent the hanging system from blocking the pathway of the spray, leaving a spot on the door that will need to be touched up later.

SUMMARY

In one aspect, a hanging device is disclosed that employs an expandable element that fits into a hole of a workpiece, such as a cabinet door designed for use with European-style hinges. The expandable element is adapted to be selectively retained within the hole of the workpiece. A hook is connected to the expandable element for use in supporting the expandable element and workpiece affixed thereto.

In another aspect, a method of holding a workpiece in which the workpiece has a hole is disclosed. The method includes inserting an expandable element into the hole of the workpiece and then manipulating a hook structure that is pivotally connected to the expandable element in order to expand the expandable element within the hole. The method further comprises supporting the workpiece by engaging the hook structure.

This summary is provided to establish a range of conceptions in a basic form that are described in greater detail below. This Summary is not intended to identify critical features of the claimed subject matter nor describe each embodiment of the present invention. The figures and description that follow provide more detail regarding illustrative embodiments.

BRIEF DESCRIPTION OF THE FIGURES

The disclosed subject matter will be further explained with reference to the attached figures, wherein like structure elements are referred to by like reference numerals throughout the several views.

While the figures contained herein present one or more embodiments of the disclosed subject matter, other embodiments are also considered. This disclosure is intended to be a representation and not a limitation of the disclosed subject matter. Those skilled in the art will recognize that other embodiments are possible without diverting from the spirit and scope of this disclosure.

DETAILED DESCRIPTION

This disclosure relates to a hanger that is used when finishing a cabinet door, where that cabinet door is adapted to receive European-style hinges therein. For each of such hinges, the door has a hole drilled or formed therein. Typically, the hole does not extend completely through the cabinet door material, so the front of the door shows no hole at all, and all of the hinge hardware is on the back of the door, and is not visible when the cabinet door is shut. The hanger disclosed in this patent application uses an expandable element or plug that fits into the cup hole (typically, a 35 mm hole) that is already present in a cabinet door for use in receiving a European-style hinge. The plug is expanded in the hole via operation of a cam, locking it in place. The hanger has a rod with a hook on the end of the rod for hanging the door while finishing it. While affixed to the door, the rod extends generally parallel to the surface of the door. When the finish applied to the door is dry, the hook is lifted relative to the door's surface, rotating the cam and releasing the plug, so that the expandable element can be withdrawn from the hold in the door.

Figure 1:
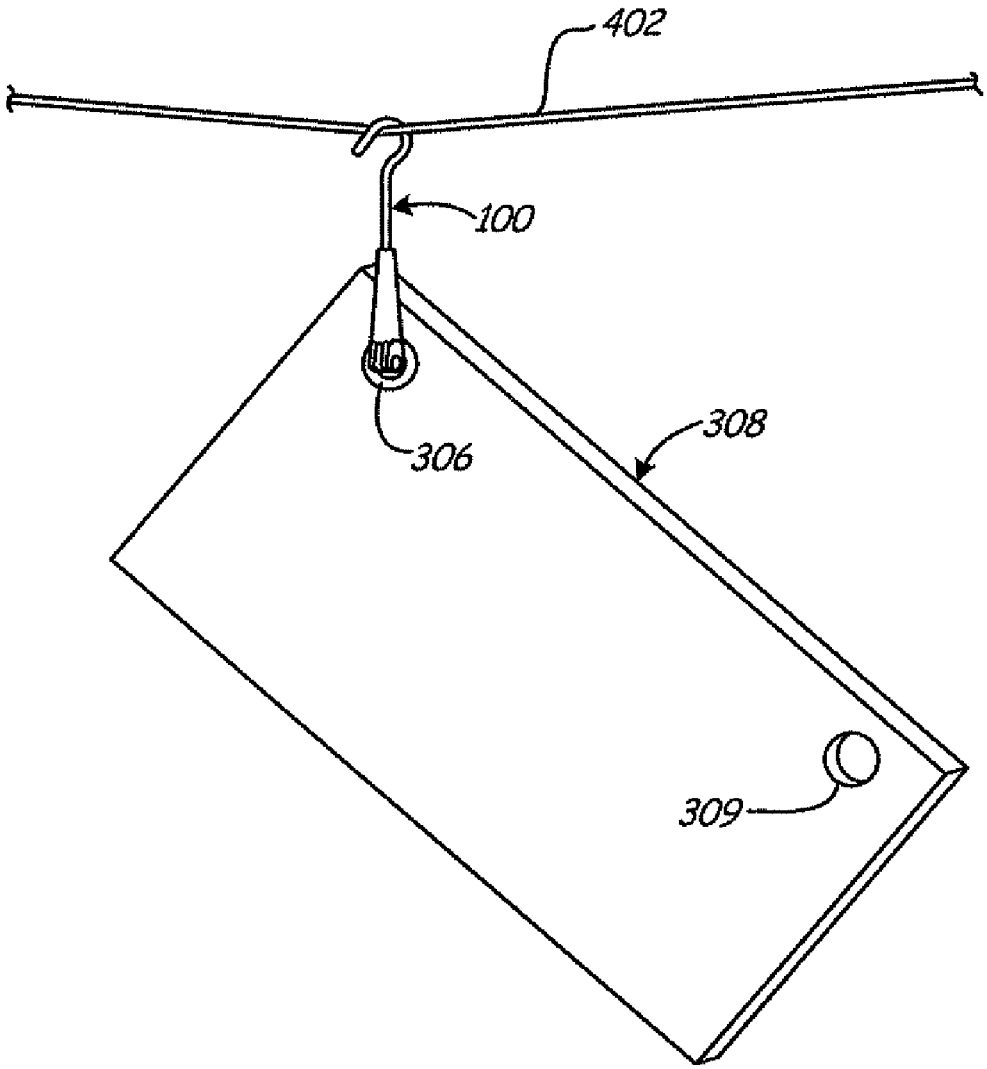
FIG. 1 is a perspective view of a hanging device being utilized to support a workpiece.
Figure 2:
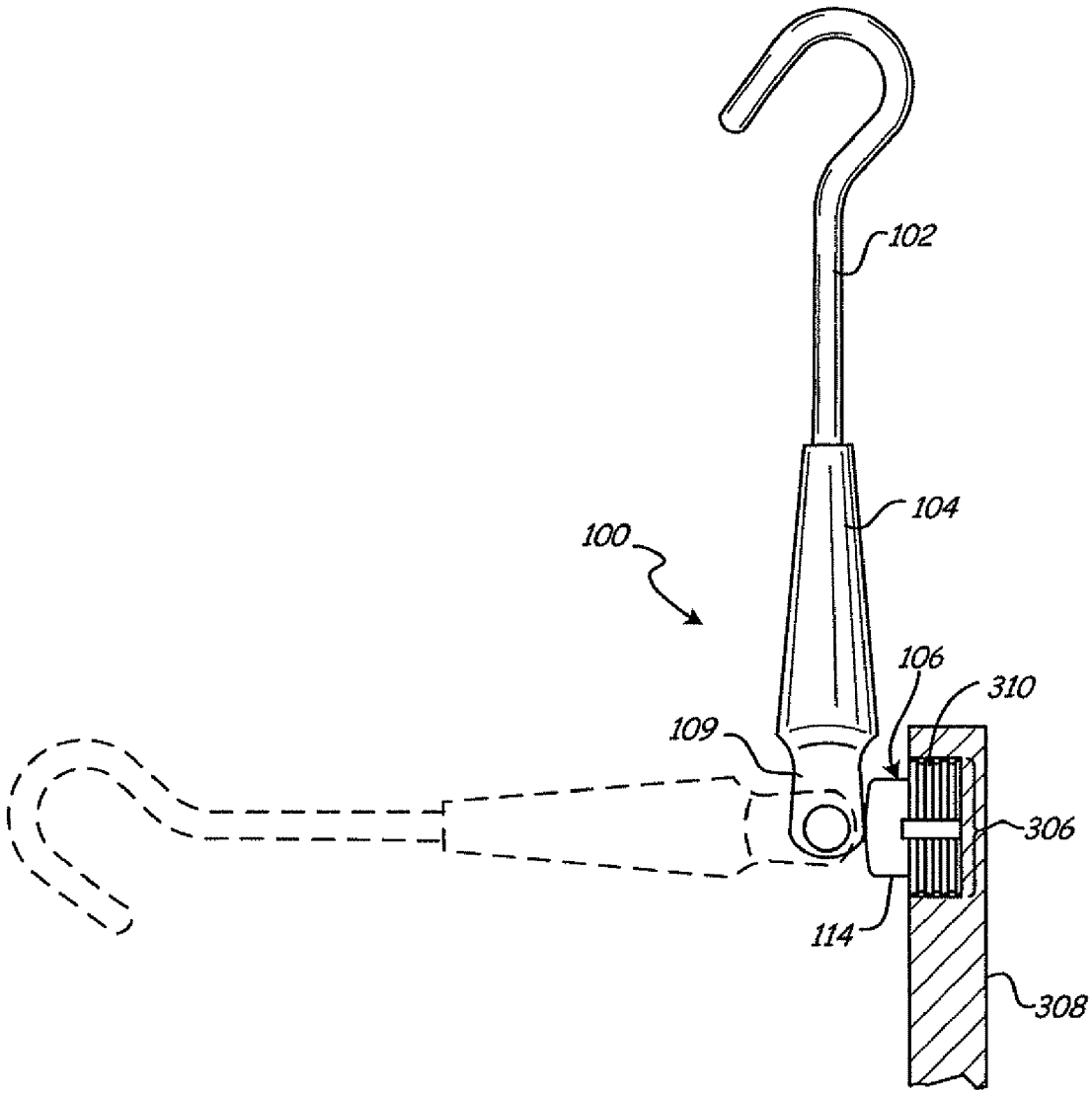
FIG. 2 is a sectional view of a workpiece having the hanging device affixed thereto.

FIG. 1 shows a hanging device 100 engaged within a hole 306 of the workpiece 308. In this illustrative example, the workpiece 308 is a cabinet door and includes the hole 306 and a second hole 309. Each of the holes 306 and 309 is adapted to receive a disc-shaped body of a European-style hinge therein, and each hole does not extend completely through the workpiece 308, as illustrated in FIG. 2. The hanging device 100, once affixed to the workpiece 308, can be used to support the workpiece 308 from a suitable hanging environment, such as a hook, rod, truss, etc. (or cable 402, such as illustrated in FIG. 1). When the workpiece 308 is supported on the cable 402, the workpiece 308 can be sprayed with lacquer or paint with minimum interference of the hanging device 100 in the spray pathway. When coating of the workpiece 308 is finished and cured, so that the workpiece 308 can again be handled, the hanging device 100 detached from the workpiece for reuse.

Figure 3:
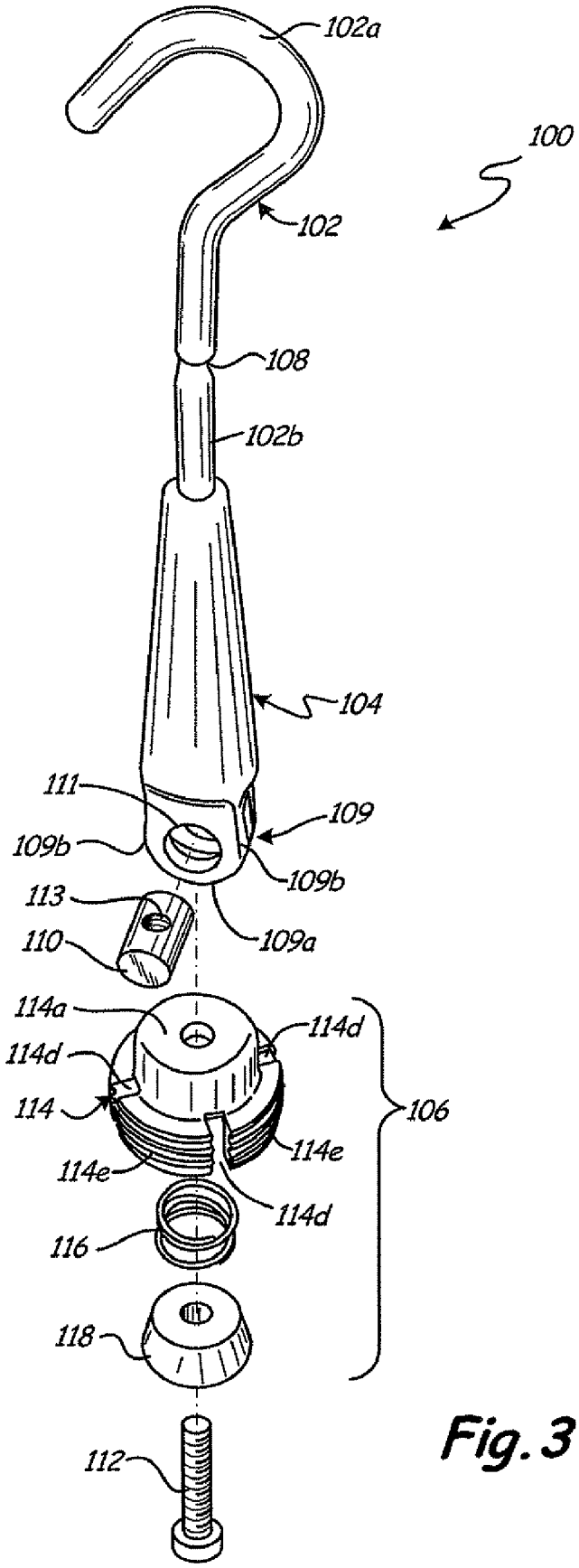
FIG. 3 is an exploded perspective view of a hanging device of the present disclosure.

FIG. 3 is an exploded view of the components of the hanging device 100. The hanging device 100 comprises a hook structure 102 (having a hook 102*a* and a rod 102*b*), a cam body 104, and an expandable element 106. In one embodiment, the hook structure 102 contains a pivotal connection 108 disposed between the hook structure 102 and the cam body 104 which allows the hook structure 102 to be rotated with 360 degrees of freedom relative to the cam body 104, about an axis of the rod 102*b*. The pivotal connection 108 is described in greater detail below. In one embodiment, the hook structure 102 is releasably connected to (e.g., threaded into) the cam body 104 so it can be replaced with other hanging options (e.g., clamps, tethers, magnets, elastic straps, etc.), if desired by the user. The cam body 104 contains a cross dowel 110 that allows the expandable element 106 to be attached to the cam body 104 via a spreader rod (e.g., a threaded bolt 112). The cross dowel 110 is rotatably received within a cross-hole 111 in the cam body 104, and itself has a threaded bore 113 for reception of the threaded bolt 112. The expandable element 106 comprises a cup 114, a spacer 116, and a plug 118 which is slidable within the cup 114. As seen in FIG. 3, the cam body 104 has a yoke 109 bearing cam surfaces 109*a* and 109*b* thereon, that are adapted to contact a top surface 114*a* of the cup 114. The yoke 109 is sized to accommodate the threaded bolt 112 extending therein to access the cross dowel 110. The cross dowel 110 is rotatable relative to the cam body 104 about a cross dowel axis, and the cam surface 109*a* is closer to the cross dowel axis than the cam surfaces 109*b*.

Figure 4:
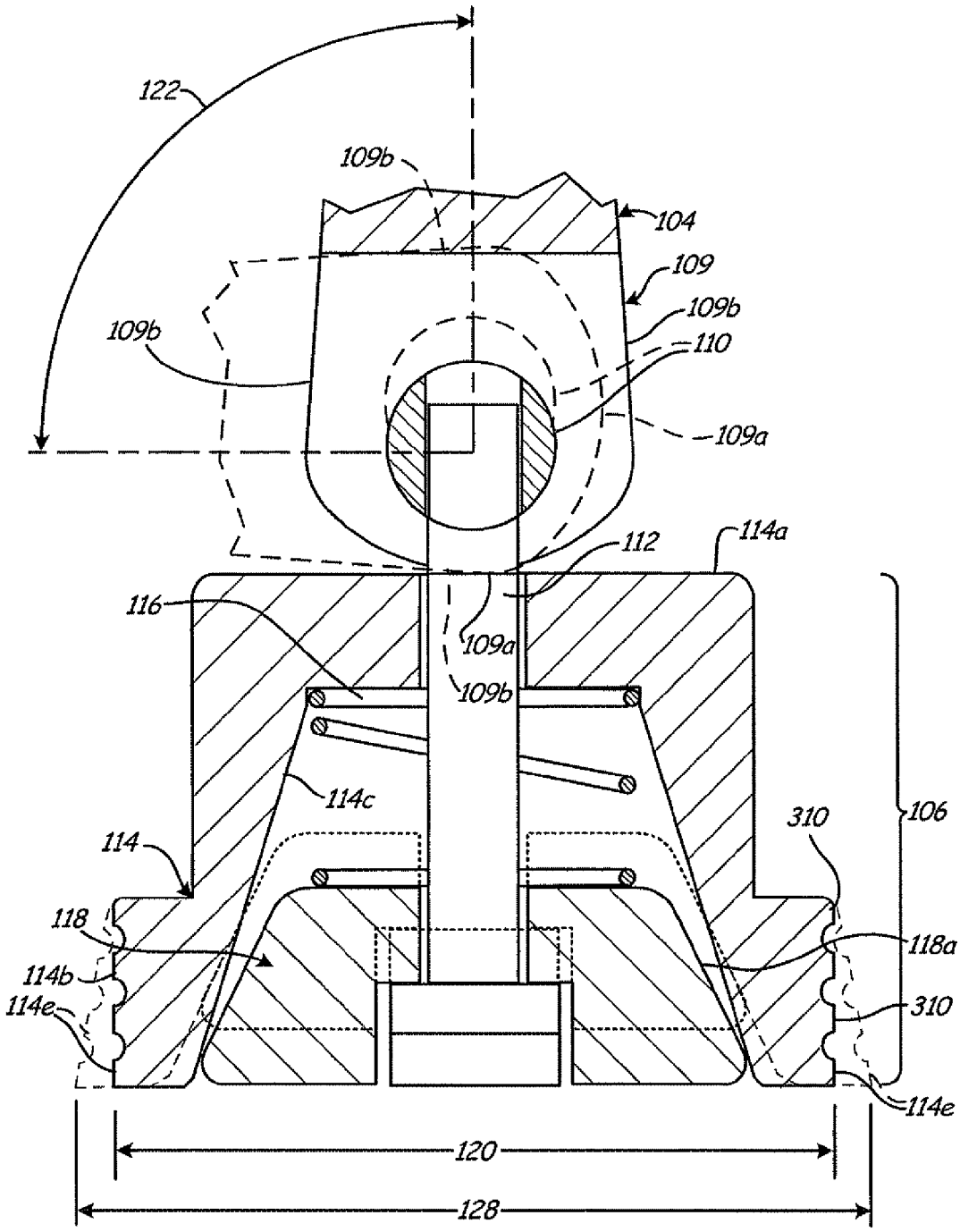
FIG. 4 is a sectional view of an expandable element of the hanging device, showing examples of its expanded position (phantom lines) and its contracted position (solid lines).

FIG. 4 shows a sectional view of the expandable element 106 and the cam 104 in both relaxed and engaged states. In order to engage the expandable element within the hole 306 of the workpiece 308 (FIGS. 1 and 2), the cam body 104 is rotated relative to the expandable element 106 about the cross dowel axis until the expandable element 106 is enlarged to at least the same diameter as the hole 306 of the workpiece 308. A lower portion 114*b* of the cup 114 of the expandable element 104 has a first contracted diameter 120 when the cam body 104 and the spreader bolt 112 are in a linear configuration, as indicated in solid lines in FIG. 4 (and in phantom lines in FIG. 2). When the hanging device 100 is in this first position, top surface 114*a* of the cup 114 is functionally abutted against the cam surfaces 109*a* of the yoke 109 on the cam body 104. When the cam body 104 is rotated along arc 122 (approximately 90° in either direction, about the axis of the cross dowel 110), the cup 114 is forced into a second position that has a further distance from the axis of the cross dowel 110. In this second position, the hanging device 100 has the top surface 114*a* of the cup 114 abutting one of the cam surfaces 109*b* of the yoke 109 on the cam body 104 (as illustrated in phantom in FIG. 4). This causes the spreader bolt 112 to pull the plug 118 into the cup 114 against the bias of spacer 116. The plug 118 has a frusto-conical shape in which sidewalls 118*a* thereof have a similar or more acute angle relative to the bottom of the plug 118 than inner sidewalls 114*c* of the cup 114. When the cup 114 has expanded to fill the hole 306 and cannot expand any further, the cup 114 and plug 118 materials may deform and the spacer 116 may be further compressed to permit the hook structure 102 to be aligned generally parallel to the surface of the workpiece 308. As seen in FIG. 3, the lower portion 114*b* of the cup 114 has a plurality of slots or cut-outs 114*d* therein, thereby defining a plurality of wall sections 114*e*. Therefore, when the spreader bolt 112 pulls the plug 118 into the cup 114, the wall sections 114*e* of the cup 114 spread outwards, thus assuming (at least adjacent a bottom of the cup 114) a second cup diameter 128. The amount of cup 114 expansion can be adjusted by tightening or loosening the spreader bolt 112 in the threaded bore 113 in the cross dowel 110. When the cam body 104 is pivoted back to the position shown in solid in FIG. 4, the spacer 116 urges the plug 118 away from the cup 114, and the cam surface 109*a* again engages the top surface 114*a* of the cup 114.

In one embodiment, the spreader bolt 112 is adjusted so that the cup 114 can be freely rotated 360 degrees about the axis of the bolt 112 without tightening or loosening of the cup 114 on the spreader bolt 112, as the bottom, tapered head of the spreader bolt 112 does not have nibs. A lock-tite or a nylon bushing system may be employed to allow the spreader bolt 112 to be adjusted while preventing it from loosening or tightening during use. In one embodiment, the cam body 104, cup 114 and plug 118 are formed from polymer materials, and the hook structure 102 is formed from steel. As discussed above, relative surfaces of such polymer components engage, may deform, and slide or pivot relative to one another. In addition, the lower portion 114*b* of the cup 114 deforms to expand outwardly, as seen in FIG. 4. The components of the hanging device 100 comprise rounded edges so as to avoid excessive buildup of lacquer or paint within the device, improving the duration of utility of the hanging device 100 and minimizing the possibility that lacquer or paint will drip onto the workpiece 308.

FIG. 2 shows a side view of the hanging device 100 in its relaxed state (in phantom) and engaged state (in solid) within the hole 306 of the workpiece 308. When the hanging device 100 is in the relaxed state, the cup 114 of the expandable element 106 has a first contracted diameter that is smaller than the hole 306 of the workpiece 308. When in this state, the cam body 104 is rotatable relative to the expandable element 106, about the axis of the threaded bolt 112. When the hanging device 100 is in the engaged state, the cup 114 of the expandable element 106 has a second expanded diameter that is at least as large as the hole 306 of the workpiece 308. The hanging device 100 is then able to support the workpiece 308 when the hook structure 102 is engaged with some other support structure (such as a user's hand or the cable 402 in FIG. 1). An outer surface of the lower portion 114*b* of the cup 114 may contain ridges 310 to enhance the frictional engagement of the hanging device 100 within the hole 306 of the workpiece 308.

Figure 5:
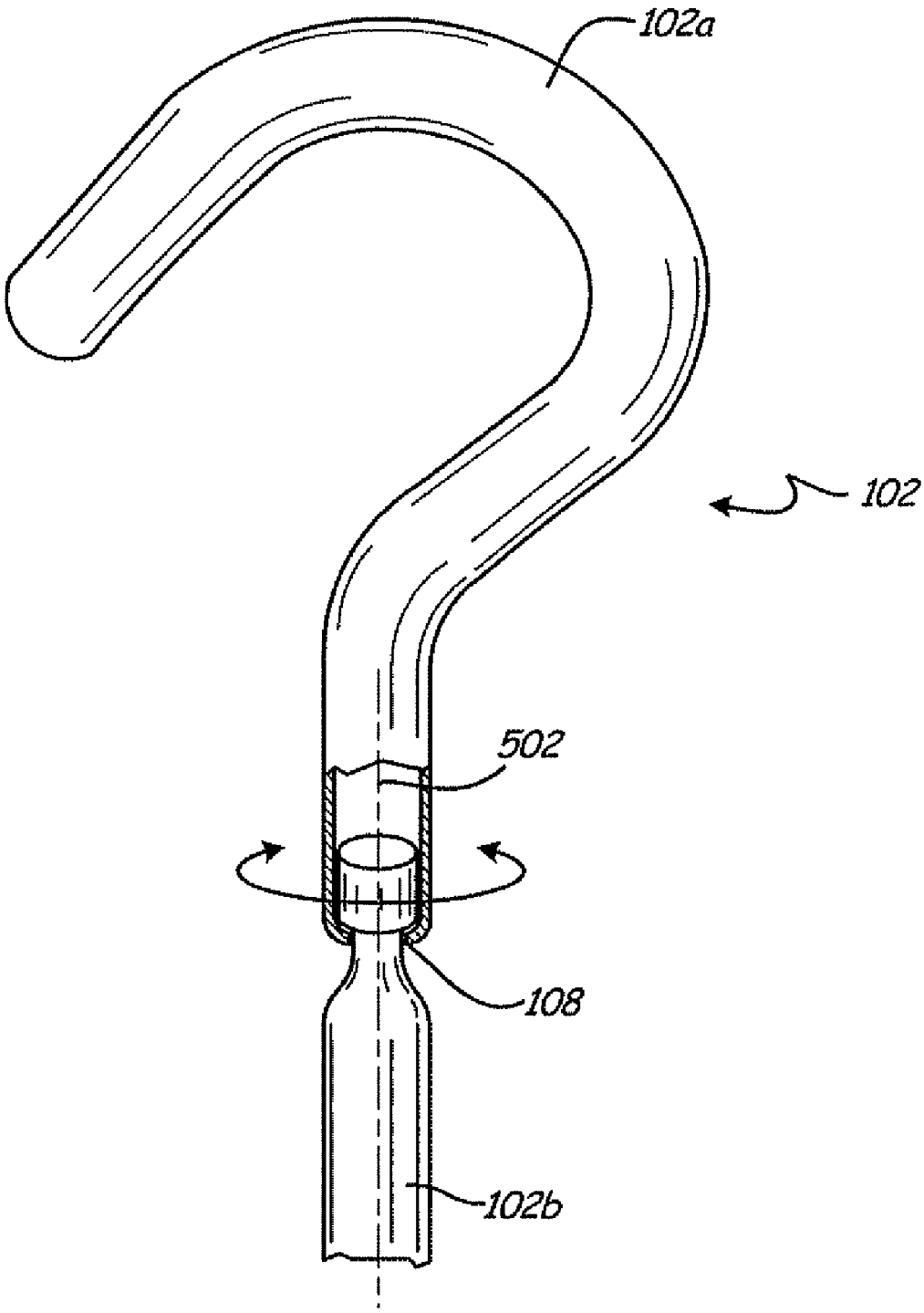
FIG. 5 is a partial sectional view of a pivotal connection within a hook structure of the hanging device.

FIG. 5 is an enlarged partial exposed view of pivotal connection 108 on the hook structure 102. Pivotal connection 108 employs an elongated ball and socket-t type joint that allows for 360 degrees of freedom of rotation about an axis 502 of the rod 102*b* of the hook structure 102, without allowing bending of the hook structure 102. The pivotal connection 108 allows a workpiece affixed to the hanging device 100 to be rotated once the hanging device 100 has been mounted on a support structure in order to conveniently access all surfaces of the workpiece.

Although the hanging device disclosed herein has been described with reference to several embodiments, those skilled in the art will recognize that changes may be made without departing from the spirit and scope of this disclosure.

What is claimed is:

1. A hanging device for suspending a workpiece from another object, the work piece having exterior surfaces, and the hanging device being attachable to the workpiece generally without touching the exterior surfaces of the workpiece, wherein the workpiece has a hole, the hanging device comprising:

an expandable cup element having an expandable portion which fits entirely within the hole, defining a first outer periphery, initially sized to be received within the hole, and then selectively expandable to a peripheral size greater than said first outer periphery when within the hole by expansion of the element after insertion into the hole of the workpiece; and a hook connected to the expandable element for use in supporting the expandable element and workpiece affixed thereto from said other object.

2. A hanging device for suspending a workpiece from another object, the work piece having exterior surfaces, and the hanging device being attachable to the workpiece generally without touching the exterior surfaces of the workpiece, wherein the workpiece has a hole, the hanging device comprising:

an expandable element comprises a cup adapted to be selectively retained within the hole by expansion of the element after insertion into the hole of the workpiece; and a hook connected to the expandable element for use in supporting the expandable element and workpiece affixed thereto from said other object.

3. The hanging device of claim 2 wherein the expandable element comprises a cup, a plug slidable within the cup and a spreader rod operably coupled to the cam.

4. A hanging device for holding a workpiece, wherein the workpiece has a hole, the hanging device comprising:

an expandable element comprising a plurality of discontinuous wall sections together defining a first outer periphery, initially sized to be received within the hole, and then selectively expandable to a peripheral size greater than said first outer periphery when adapted to be selectively retained within the hole of the workpiece; and wherein the expandable element is inserted within the hole and retained therein by expansion of the element after insertion;

a plug at least partially received within said expanding element, a hook connected to the expandable element for use in supporting the expandable element and workpiece affixed thereto, and wherein movement of the plug expands said element.

5. The hanging device of claim 3 wherein the expandable element comprises a spacer to bias the plug away from the cup.

6. The hanging device of claim 3 wherein the plug has a first extended position relative to the cup when the cam is in a first relaxed state and the plug has a second retracted position relative to the cup when the cam is in a second engaged state.

7. The hanging device of claim 1 wherein the expandable element has a first contracted position having a smaller diameter than the hole in the workpiece and a second expanded position having a diameter at least as large as the diameter of the hole in the workpiece.

8. The hanging device of claim 1 and further comprising:

a pivotal knuckle disposed between the expandable element and the hook.

9. A method of suspending a workpiece from another object, wherein said workpiece has a hole and exterior surfaces, the method providing for the workpiece to be suspended generally without touching the exterior surfaces of the workpiece, the method comprising:

inserting an expandable cup element of diameter less than that of the hole into the hole of the workpiece;

manipulating the expandable cup element pivotally, to expand the expandable cup element when placed within the hole to having a diameter larger than said hole to create frictional contact so that the cup element is not easily removed; and supporting the workpiece by engaging the hook structure from said other object.

10. The method of claim 9 and further comprising:

positioning the workpiece at various angles relative to the hook by manipulating a pivoting knuckle located on the hook structure.

11. The method of claim 9 wherein the expandable element comprises a cup, a plug slidable within the cup, a spacer biasing the plug away from the cup, and a spreader rod coupling the plug to the hook structure.

12. A hanging device for suspending a workpiece from another object, wherein the workpiece has exterior surfaces and a cup hole is formed in said exterior surface to expose an interior surface, the hanging device comprising:

an expandable element adapted to have a first contracted size smaller than said cup hole, and a second expanded size larger than said cup hole and an adjustor capable of switching said element from between said first and second sizes, so that the element can be attached to the workpiece without substantial contact with the exterior surfaces by insertion of the element into the cup hole when contracted and locking said element into the cup hole when expanded;

a hanging attachment connected to said expandable element capable of attaching the element to said other object and wherein said adjustor includes, a cam, a plug slidable within the expandable element and a spreader rod operably coupled to the cam.

13. The device according to claim 12 wherein said cup hole is recess into the object below the exterior surface.

14. The device of claim 12 wherein the cup hole is a hole.

15. The device of claim 12 wherein said adjustor includes, a cam, a plug slidable within the expandable element and a spreader rod operably coupled to the cam and wherein said expandable element includes a plurality of discontinuous wall sections together defining a first outer periphery.

16. The device of claim 12 wherein the expanding element has a central axis and where said hanging attachment has a central axis and wherein said cam has a first position where the axes are aligned and where the element is in the contracted position and a second position where the axes are non-aligned and the element is in the expanded position and positioned.

17. The device of claim 16 wherein said non-aligned axes are generally perpendicular.

18. The device of claim 12 wherein said adjustor includes a resilient element to maintain said plug in contact with said expandable element.

19. The device of claim 18 wherein the plug has a conical surface of a first predetermined pitch and wherein said expanding element has a conical recess of a second predetermined pitch and wherein said pitches are unequal.

* * * * *